US005632786A

United States Patent [19]

Basu et al.

[11] Patent Number: 5,632,786

[45] Date of Patent: May 27, 1997

[54] PROCESS AND FUEL FOR SPARK IGNITION ENGINES

[75] Inventors: Arunabha Basu, Naperville, Ill.; Theo H. Fleisch, Houston, Tex.; Christopher I. McCarthy, Naperville; Carl A. Udovich, Joilet, both of Ill.

[73] Assignee: Amoco Corporation, Chicago, Ill.

[21] Appl. No.: 528,119

[22] Filed: Sep. 14, 1995

[51] Int. Cl.[6] ..... C10L 3/00; C10L 1/18

[52] U.S. Cl. ..... 44/448; 123/1 A

[58] Field of Search ..... 44/448; 123/1 A; 48/197 FM

[56] References Cited

U.S. PATENT DOCUMENTS

| | | | |
|---|---|---|---|
| 1,565,933 | 12/1925 | Harris | 44/414.8 |
| 1,990,499 | 2/1935 | Odell | 44/448 |
| 2,469,751 | 5/1949 | Sweeney | 44/300 |
| 2,948,595 | 8/1960 | Orr | 48/197 FM |
| 2,951,750 | 9/1960 | White | 48/197 FM |
| 3,361,544 | 1/1968 | Kaiser, Jr. | 44/448 |
| 4,177,040 | 12/1979 | Kaiser, Jr. | 44/448 |
| 4,743,272 | 5/1988 | Weinberger | 44/448 |
| 4,892,561 | 1/1990 | Levine | 44/448 |

FOREIGN PATENT DOCUMENTS

| | | |
|---|---|---|
| 2149113 | 3/1973 | France . |
| 2056131 | 5/1972 | Germany . |
| 103908 | 9/1976 | Japan . |
| 6086195 | 5/1985 | Japan . |
| 1066461 | 11/1992 | Japan . |
| 9401515 | 1/1994 | WIPO . |

OTHER PUBLICATIONS

Article by X. Wang entitled: Developments and Applications of Ether-based Fuels, reportedly published in Natural Gas Chemical Industry, vol. 19 No. 6 (1994), pp. 45–49 month unknown.

*Primary Examiner*—Margaret Medley

*Attorney, Agent, or Firm*—Robert A. Yesukevich; Richard A. Kretchmer

[57] ABSTRACT

A method is described for operating a spark ignition internal combustion engine utilizing an improved composition containing dimethyl ether and propane as fuel. An engine incorporating the invention produces a lesser amount of certain atmospheric pollutants, such as carbon monoxide and unburned hydrocarbons, as compared to the amount of pollutants produced when the engine is operated at identical conditions with propane as fuel. Also described is an improved fuel composition which exhibits a lower vapor pressure than, for example, propane and, therefore, is relatively easier to liquefy and transport.

7 Claims, 1 Drawing Sheet

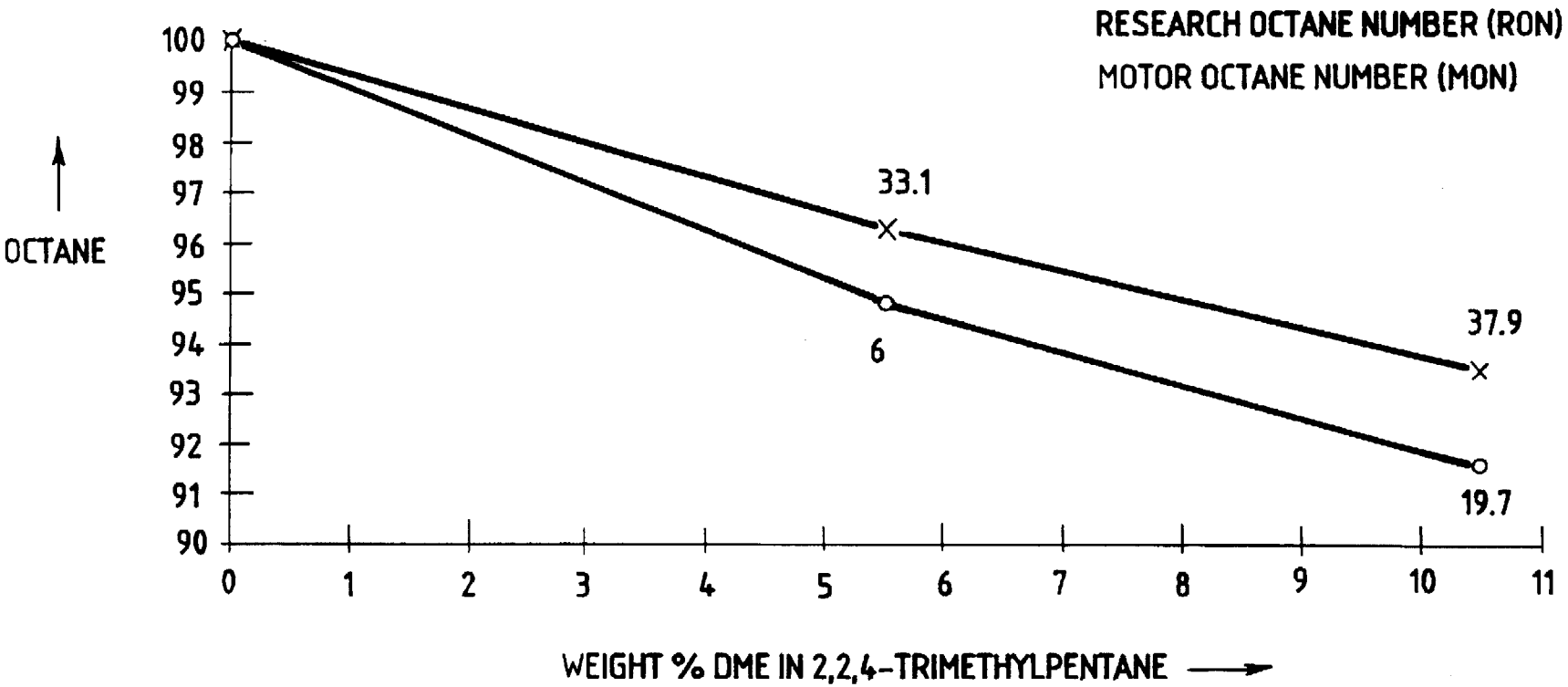
RESEARCH OCTANE NUMBER (RON)
MOTOR OCTANE NUMBER (MON)
37.9
19.7
33.1
6
100
99
98
97
96
95
94
93
92
91
90
0
1
2
3
4
5
6
7
8
9
10
11
OCTANE
WEIGHT % DME IN 2,2,4-TRIMETHYLPENTANE

PROCESS AND FUEL FOR SPARK IGNITION ENGINES

BACKGROUND OF THE INVENTION

I. Field of the Invention

The invention relates generally to the utilization of a mixture of dimethyl ether and low molecular weight alkanes and alkenes as an improved fuel for spark ignition internal combustion engines. More specifically, the invention relates to a process and an improved fuel which produce relatively less of certain atmospheric pollutants than are produced by, for example, propane fuel.

II. Description of the Prior Art

Dimethyl ether, also known as methoxymethane or methyl ether, is of the formula $CH_3$—O—$CH_3$. Having a relatively low vapor pressure as compared to compressed natural gas, dimethyl ether is readily transportable. Additionally, dimethyl ether can be economically produced in relatively small quantities, as compared to materials such as natural gas which require economies of scale associated with large cryogenic plants to be produced competitively. However, pure dimethyl ether exhibits an octane number which is too low for use in modern spark-ignition internal combustion engines.

Dimethyl ether has found acceptance as a starter fluid for gasoline fueled engines. U.S. Pat. No. 4,177,040 issued to Kaiser reports a starter fluid in aerosol spray form containing an alkyl ether, a propellant and a petroleum distillate. The use of such starter fluids in a particular engine is usually initiated when the engine is cold and discontinued as soon as the engine is operating reliably.

Various blends of dimethyl ether and alcohols have been proposed as spark-ignition engine fuels. For example, U.S. Pat. No. 4,743,272 issued to Weinberger describes a gasoline fuel substitute which includes a major amount of specified anhydrous alcohol mixtures containing methanol or ethanol and a minor amount of specified ketone or ether mixtures. While dimethyl ether-alcohol fuels are satisfactory in some respects, the alcohol components are generally toxic to humans.

Gaseous fuels such as ethane, propane, butane and mixtures thereof have been pressed into service as spark ignition engine fuels from time to time, especially during temporary fossil fuel shortages. Currently, gaseous fuels are the fuels of choice for spark ignition engines when exhaust pollutants must be minimized. For example, propane fueled fork lift vehicles are operated in warehouses where exhaust gases tend to accumulate. To the present day, however, the general public has not consistently adopted gaseous fuels, such as propane, as primary automotive fuels for routine service.

The gaseous fuels are frequently utilized as heating fuels. A fuel gas composition containing five to thirty percent by weight dimethyl ether and a balance of two or more hydrocarbons selected from the group consisting of propane, propylene, butane, and butylene is described in Japanese Kokai Patent No. JP 6086195 assigned to Idemitsu Petrochemical. The Japanese Patent states that the fuel gas composition is suitable for use in industrial plants and in large kitchens.

U.S. Pat. No. 4,892,561 issued to Levine describes fuels for internal combustion engines which contain at least fifty percent by weight of dimethyl ether. For example, the Levine Patent states that a mixture of approximately equal weights of propane and methyl ether is suitable for use as fuel for spark ignition engines. As will be explained in more detail below, the equal weights mixture endorsed by the Levine Patent has a research octane of about 73 and a motor octane number of about 55 and, therefore, cannot be utilized as a fuel for modern spark-ignition engines.

A need still exists for an improved fuel composition for spark-ignition internal combustion engines that exhibits an octane number appropriate for use in conventional automobiles. Desirably, the improved fuel can operate in existing automotive engines without major engine modifications. More desirably, the improved fuel is manufactured from materials which are widely available and produces a relatively small amount of atmospheric pollutants, as compared to propane and conventional fossil fuels.

SUMMARY OF THE INVENTION

The invention is a method for operating a spark ignition internal combustion engine utilizing an improved fuel containing dimethyl ether (of the formula $CH_3$—O—$CH_3$) and propane as fuel. An engine incorporating the invention produces a lesser amount of certain atmospheric pollutants, such as carbon monoxide and unburned hydrocarbons, as compared to the amount of pollutants produced when the engine is operated at identical conditions with propane as fuel. The improved composition exhibits an octane number suitable for use in existing automotive engines. Additionally, the improved composition usually has a lower vapor pressure than, for example, propane and is, therefore, relatively easy to liquefy and transport.

In one aspect, the invention is a method of operating a spark ignition internal combustion engine. The method includes vaporizing a liquid phase mixture composed of about 10 to about 30 weight percent dimethyl ether and about 90 to about 70 weight percent propane to produce a gaseous fuel. Air and the gaseous fuel are passed into a cylinder of the engine and ignited by a spark.

In another aspect, the invention is a fuel composition suitable for use in a spark ignition internal combustion engine, which comprises in the range of about 10 to about 30 weight percent dimethyl ether and about 90 to about 70 weight percent propane.

BRIEF DESCRIPTION OF THE DRAWING

FIG. 1 is a graph presenting the experimentally determined research octane number and the motor octane number of various blends of dimethyl ether (DME) and isooctane (2,2,4-Trimethyl pentane). The data of FIG. 1 indicates that the octane blending numbers of dimethyl ether are 35.5 research octane and 12.8 motor octane.

DETAILED DESCRIPTION OF PREFERRED ASPECTS OF THE INVENTION

In a preferred aspect, the invention is a method of fueling a spark ignition internal combustion engine which comprises vaporizing a liquid phase mixture containing propane and dimethyl ether to produce a gaseous fuel. It is preferred that the mixture is initially in liquid phase so that an associated liquid phase storage system can be relatively compact and portable, as compared to typical vapor phase storage systems. Additionally, to minimize the weight and cost of the liquid storage system, the vapor pressure of the mixture should be as low as possible without sacrificing reliable cold starting and engine operation in cooler climates. Pure propane exceeds vapor pressure requirements for spark-ignition engines, which require about two atmospheres absolute vapor pressure under actual operating conditions.

Preferably, the mixture contains a substantial amount of dimethyl ether, more preferably at least about 10 weight percent, most preferably at least about 15 weight percent of dimethyl ether, with the balance of the mixture composed substantially of propane.

On the other hand, too high a proportion of dimethyl ether makes the mixture unsuitable for fueling spark ignition engines. Regular grade gasoline typically has a research octane number of about 92 to about 95, and a motor octane number of about 83 to about 86. By statute, regular grade gasoline must currently deliver a minimum of 87 research octane number plus motor octane number divided by two (R+M/2). Therefore, it is preferred that the mixture contains no more than about 30 weight percent, more preferably no more than about 25 weight percent, and most preferably about 20 weight percent of dimethyl ether with the balance of the mixture composed substantially of propane.

The mixture may additionally contain minor amounts of, for example, ethane, ethene, propane, propenes, butanes, butenes, pentanes and pentenes. The mixture may also contain trace amounts of alcohols, ketones, aromatics, water and ethers other than dimethyl ether.

Preferably, the mixture containing propane and dimethyl ether is withdrawn from a fuel tank in liquid phase and vaporized downstream of the fuel tank based on the direction of mixture flow, to produce a gaseous fuel. Air and the gaseous fuel are passed into a cylinder of a spark ignition internal combustion engine. The air and the gaseous fuel blend to produce a combustible mixture. It is preferred that air mixes with the gaseous fuel in a carburetor before entering the cylinder. Such carburetors are in use today for propane powered vehicles. A gaseous fuel injection system could be used as an alternative to the carburetor. In the cylinder, a spark is induced which ignites the aerated fuel, giving rise to a combustion reaction which liberates energy to drive the engine.

The combustion produces an exhaust stream containing nitrogen, carbon dioxide, and water as well as less desirable materials including, for example, nitrogen oxides, carbon monoxide, and unburned fuel. It is preferred that the exhaust stream includes less hydrocarbon, which is indicative of unburned fuel, and less carbon monoxide and more carbon dioxide as compared to an exhaust stream produced by an identical engine under the same conditions. The exhaust stream is vented from the cylinder to the atmosphere.

It is especially preferred that the present invention is practiced in an automobile or truck or bus engine designed for operation with gasoline as fuel, but converted to operation with a dimethyl ether-propane mixture as fuel. The conversion to dimethyl ether-propane fuel is typically straightforward, and does not usually require modifying any internal engine components. Generally, the conversion involves only external bolt-on components and is accomplished by installing a storage vessel capable of withstanding the vapor pressure of the dimethyl ether-propane mixture, a regulator for reducing the pressure of and vaporizing the mixture, and a carburetor adapted for blending air with the mixture. If rubber or plastic fittings are in a position to contact the dimethyl ether-propane mixture, they should be replaced with fittings which can better withstand dimethyl ether service.

In another preferred aspect, the invention is a fuel composition suitable for use in a spark ignition internal combustion engine which preferably comprises about 10 to about 30 weight percent, more preferably 15 to about 25 weight percent, and most preferably about 20 weight percent based on the total weight. Propane substantially composes the balance of the mixture. The mixture may additionally contain as lesser components minor amounts of, for example, ethane, ethene, propanes, butanes, butenes, pentanes and pentenes. The mixture may also contain trace amounts of ethers having greater molecular weight as compared to dimethyl ether, alcohols, ketones, aromatics, and water.

The following examples are presented in order to better communicate the invention. The examples are not intended to limit the scope of the invention in any way.

EXAMPLE 1

Octane Numbers of Dimethyl Ether-Isooctane Blends

Two blends containing dimethyl ether and isooctane were prepared, and each of the blends was rated for research octane number (RON) and motor octane number (MON) using generally accepted rating procedures. The blends contained 5.53 weight percent and 10.46 weight percent of dimethyl ether, respectively, with isooctane as the balance of the blend. The results of the octane rating are presented in FIG. 1.

By definition, the research octane number and the motor octane number of isooctane are 100. Assuming that the octane blending relationship is adequately described by a linear mixing equation, and applying the data of FIG. 1, the blending octane numbers for dimethyl ether can be calculated as 35.5 research octane and 12.8 motor octane.

EXAMPLE 2

Octane Numbers of Equal Weights Dimethyl Ether-Propane Blend

A blend containing equal weights of dimethyl ether and propane is prepared. The blend is rated for research octane number (RON) and motor octane number (MON) using generally accepted rating procedures. The research octane number of the blend is reported as 73 and the motor octane number as 55. The research octane number plus motor octane number divided by two value (R+M/2) is 64. It is apparent from the reported octane numbers that the equal weights blend cannot perform acceptably as fuel for a spark ignition engine.

EXAMPLE 3

Octane Numbers of Several Dimethyl Ether-Propane Blends

Several blends of dimethyl ether and propane are prepared. The research octane number and motor octane number of each blend are determined by analysis. The vapor pressure of each blend is also determined. The results are shown in Table B, below. Values are included for pure propane, for reference.

TABLE A

OCTANE NUMBERS OF SEVERAL BLENDS

| | | | | | | |
|---|---|---|---|---|---|---|
| Dimethyl Ether (weight percent) | | 10 | 15 | 20 | 25 | 30 |
| Propane (weight percent) | 100 | 90 | 85 | 80 | 75 | 70 |
| RON | 111.5 | 103.9 | 100.1 | 96.3 | 92.5 | 88.7 |

TABLE A-continued

| OCTANE NUMBERS OF SEVERAL BLENDS | | | | | | |
|---|---|---|---|---|---|---|
| MON | 100 | 91.3 | 86.9 | 82.6 | 78.2 | 73.8 |
| R + M/2 | 106 | 97.6 | 93.5 | 89.5 | 85.4 | 81.25 |
| Vapor Pressure @ 30° F. (psig) | 262 | 253 | 248 | 244 | 239 | 234 |

EXAMPLE 4

Operation of 3.8 Liter Engine with Propane as Fuel

A 1988 Buick Century automobile having a 3.8 liter engine originally manufactured to utilize gasoline as fuel was fitted with a pressurized fuel tank, a pressure reducing and vaporizing valve, and a carburation system suitable for use with propane as fuel. The propane was held in liquid phase in the fuel tank until needed, then vaporized to produce gaseous propane. As a control test, the automobile was operated over a distance of approximately ten miles under conditions conforming to United States Environmental Agency test procedure EPA78. The type and amount of emissions and the fuel economy observed during the test procedure with propane as fuel are presented in Table B, below.

The data in Table B indicate, as expected, that propane is a desirably efficient and relatively clean burning automotive fuel as compared to well-known conventional automotive fuels, such as gasoline.

EXAMPLE 5

Operation of 3.8 Liter Engine with 19 Wt. % Dimethyl Ether-Propane Mixture as Fuel The automobile described in Example 4, above, was subjected to the EPA78 test procedure over a distance of about ten miles, except that in this instance the automobile was fueled by a gaseous mixture containing 18.7 weight percent dimethyl ether and 91.3 weight percent propane. The 19 weight percent mixture was held in liquid phase in the pressurized fuel tank and was fed to the fuel system as a liquid. The liquid fuel was vaporized at the engine, before the carburetor, to produce the gaseous mixture. The results of the test procedure utilizing the weight percent dimethyl ether-propane mixture are presented in Table B, below.

TABLE B

Emission Test Results

| Type of Emission | Amount of Emission (Grams per Mile Weighted Over Time) With Propane as Fuel | With 19% Dimethyl ether-Propane Mixture as Fuel |
|---|---|---|
| Total Hydrocarbons | 0.532 | 0.461 |
| Carbon Monoxide | 5.664 | 3.406 |
| Carbon Dioxide | 354.628 | 367.582 |
| Nitrogen Oxides | 0.783 | 0.886 |
| Fuel Economy (miles per gallon) | 15.74 | 14.92 |

From the data in Table B, it can be seen that the dimethyl ether-propane fuel mixture produced relatively less total hydrocarbons per mile, weighted over time for the period of the test procedure. Hydrocarbons present in an automotive exhaust stream, as these were, are generally regarded as objectionable atmospheric pollutants. Additionally, the dimethyl ether-propane fuel mixture produced relatively less toxic carbon monoxide. The greater amount of carbon dioxide generated by the dimethyl ether-propane fuel mixture is consistent with more complete combustion.

On the other hand, the dimethyl ether-propane fuel mixture produced a slightly greater amount of nitrogen oxides and exhibited marginally lower fuel economy as compared to the propane fuel. This slight shift in nitrogen oxides emission and fuel economy is similar to the effect of adding oxygenates, such as alcohols or ethers, to gasolines. Overall, the data in Table A indicate that the the dimethyl ether-propane fuel mixture is a viable alternative fuel composition which can provide desirable automotive power while producing relatively little atmospheric pollution.

Examples have been presented and hypotheses advanced herein in order to better communicate certain facets of the invention. The scope of the invention is determined solely by the scope of the appended claims.

We claim as our invention:

1. A method of operating a spark ignition internal combustion engine having a cylinder, which comprises:
   - withdrawing from a pressurized fuel tank a liquid phase mixture consisting essentially of and propane;
   - vaporizing the mixture downstream of the fuel tank near the engine, based on the direction of mixture flow, to produce a gaseous fuel within the range of about 10 to about 30 percent by weight dimethyl ether and within the range of about 90 to about 70 percent by weight of propane, based on the total weight;
   - passing air and the gaseous fuel into a cylinder of a spark ignition internal combustion engine;
   - igniting the gaseous fuel by a spark; and
   - operating the engine over a distance of about ten miles with the dimethyl ether-propane mixture as fuel.

2. The method of claim 1 wherein the dimethyl ether is in the range of about 15 to about 25 percent by weight.

3. The method of claim 1 wherein the exhaust stream includes a relatively lesser amount of hydrocarbons as compared to an amount of hydrocarbons in the reference exhaust stream.

4. A method of fueling a spark ignition internal combustion engine having a cylinder, which comprises:
   - withdrawing from a pressurized fuel tank a liquid phase mixture consisting essentially of and propane;
   - vaporizing the mixture downstream of the fuel tank near the engine, based on the direction of mixture flow, to produce a gaseous fuel within the range of about 10 to about 30 percent by weight dimethyl ether and within the range of about 90 to about 70 percent by weight of propane, based on the total weight;
   - blending air and the gaseous fuel to produce a combustible mixture;
   - igniting the combustible mixture by a spark in a cylinder of a spark ignition internal combustion engine;
   - operating the engine over a distance of about ten miles with the dimethyl ether-propane mixture as fuel; and
   - venting from the cylinder an exhaust stream including a relatively lesser amount of total hydrocarbons as compared to an amount of total hydrocarbons in a reference exhaust stream produced by fueling the engine with propane under otherwise identical conditions.

5. The method of claim 4 wherein the exhaust stream includes a relatively lesser amount of carbon monoxide as compared to an amount of carbon monoxide in the reference exhaust stream.

6. The method of claim 4 wherein the dimethyl ether is in the range of about 15 to about 25 percent by weight.

7. The method of claim 1 wherein the exhaust stream includes a relatively lesser amount of carbon monoxide as compared to an amount of carbon monoxide in the reference exhaust stream.

* * * * *

UNITED STATES PATENT AND TRADEMARK OFFICE
CERTIFICATE OF CORRECTION

PATENT NO.: 5,632,786

DATED: May 27, 1997

INVENTOR(S): Arunabha Basu, Theo H. Fleisch, Christopher I. McCarthy, Carl A. Udovich It is certified that error appears in the above-identified patent and that said Letters Patent is hereby corrected as shown below:

| Col. | Line | |
|---|---|---|
| 5 | 7 | in "TABLE A-continued" in the last row of the first column, "@ 30°F. (psig) should read --@ 130°F. (psig)-- |
| 5 | 45-46 | "the weight percent dimethyl ether-propane mixture" should read --the 19 weight percent dimethyl ether-propane mixture-- |
| 6 | 27 | "essentially of and propane;" should read --essentially of dimethyl ether and propane;-- |
| 6 | 49 | "essentially of and propane;" should read --essentially of dimethyl ether and propane;-- |

Signed and Sealed this

Fifth Day of August, 1997

Bruce Lehman

*Attest:*

BRUCE LEHMAN

*Attesting Officer*

*Commissioner of Patents and Trademarks*